US005208946A

United States Patent [19]

Stentenbach

[11] Patent Number: 5,208,946

[45] Date of Patent: May 11, 1993

[54] GROOVED CAN COILER HAVING PIVOTABLE SLIVER CUTTING BLADE

[75] Inventor: Udo Stentenbach, Nordhorn, Fed. Rep. of Germany

[73] Assignee: Rosink GmbH & Co. KG, Nordhorn, Fed. Rep. of Germany

[21] Appl. No.: 678,353

[22] PCT Filed: Oct. 28, 1989

[86] PCT No.: PCT/EP89/01289

§ 371 Date: Apr. 19, 1991

§ 102(e) Date: Apr. 19, 1991

[87] PCT Pub. No.: WO90/05106

PCT Pub. Date: May 17, 1990

[30] Foreign Application Priority Data

Nov. 5, 1988 [DE] Fed. Rep. of Germany ..... 3837596

[51] Int. Cl.[5] ..... D01G 27/00; B65H 54/80

[52] U.S. Cl. ..... 19/159 R; 19/159 A

[58] Field of Search ..... 19/0.25, 150, 159 R, 19/159 A, 160; 57/263, 86, 90; 83/290, 913; 242/48

[56] References Cited

U.S. PATENT DOCUMENTS

| | | | |
|---|---|---|---|
| 3,083,416 | 4/1963 | Hashimoto | 19/159 R |
| 3,246,371 | 4/1966 | Tooka | 19/159 A |
| 3,334,385 | 8/1967 | West et al. | 19/159 R |
| 3,353,224 | 11/1967 | Gossett et al. | 19/159 A |
| 3,354,513 | 11/1967 | Fornes | 19/159 |
| 3,991,443 | 11/1976 | Savageau | 19/159 R |
| 4,033,104 | 7/1977 | Kamp | 19/159 R X |
| 4,561,151 | 12/1985 | Schöpwinkel | 19/159 R |
| 4,694,540 | 9/1987 | Rosink | 19/159 R |

FOREIGN PATENT DOCUMENTS

| | | | |
|---|---|---|---|
| 1760857 | 12/1971 | Fed. Rep. of Germany . | |
| 2821325 | 11/1979 | Fed. Rep. of Germany . | |
| 2841678 | 4/1980 | Fed. Rep. of Germany | 19/159 R |
| 3731885 | 4/1989 | Fed. Rep. of Germany | 19/159 A |
| 4522970 | 3/1970 | Japan | 19/159 A |
| 0374393 | 6/1932 | United Kingdom | 19/159 R |
| 1436857 | 5/1976 | United Kingdom | 19/159 A |
| 2216909 | 10/1989 | United Kingdom | 19/159 R |

*Primary Examiner*—Clifford D. Crowder
*Assistant Examiner*—Ismael Izacuirre
*Attorney, Agent, or Firm*—Robert W. Becker & Associates

[57] ABSTRACT

A can coiler with an outlet channel for a sliver is provided, whereby the outlet channel is fastened to a turn table and follows a circular path. Calender rolls for transporting the sliver are arranged before the outlet channel. A stationary sliver cutting device with a cutting element is provided, whereby the cutting element is pivotable, transverse to a longitudinal direction of the sliver, into and away from the circular path of the outlet channel into and away from a transverse groove of the turntable. The cutting element is in the form of a cutting knife with a blade and is supported such that a cutting edge for a cutting process by a pulling cutting action is moved into the circular path whereby the cutting knife, in a cutting position thereof, extends to a radial line of the circular path. The radial line is essentially vertical to the cutting edge. The cutting device ensures a flawless operation, even at high production speeds.

8 Claims, 8 Drawing Sheets

GROOVED CAN COILER HAVING PIVOTABLE SLIVER CUTTING BLADE

BACKGROUND OF THE INVENTION

1. Field of the Invention

The present invention relates to a can coiler having an outlet channel for a sliver that is fastened to a turntable or turning ring and follows a circular path whereby calender rolls are disposed before the outlet channel that serve for transporting the sliver. The can coiler is also provided with a stationary sliver cutting device which is provided with a cutting element that is supported in a pivotable manner and is insertable into and retractable from the circular path of the outlet channel in a direction transverse to the longitudinal direction of the sliver.

2. Description of the Related Art

A can coiler of the aforementioned kind is known from DE-OS 28 21 325. The cutting element is provided in the form of a comb. The comb is guided by a rotary magnet and is inserted into the sliver channel in the area of the so called funnel wheel, whereby the sliver channel is provided with a horizontally arranged slot. The sliver which is also called slubbing is essentially torn apart in a manner causing unraveling. The full width of the sliver essentially contacts the respective "obstacle". This has effects on the quality, especially on the uniform structure of the sliver, since the sudden pull is transmitted in a jerky manner into the feeding area. The density of the sliver is thus negatively influenced. Due to the unraveling of the sliver the sliver channel is easily plugged. A cutting device of the aforementioned kind, viewed from the perspective of a gentle and careful cutting, is thus not satisfactory. Furthermore, the cutting device is also disadvantageous with respect to its construction because the sliver cutting device is arranged above the stock head. This results in a space demanding superstructure that limits access especially for cleaning purposes. A sliver cutting device is known from U.S. Pat. No. 3 354 513 in which the cutting element is provided in the form of scissors. Since it is required today that the can coiler exchange takes place at full production speed, the U.S. Pat. No. 3 354 513 does not fulfill these requirements. During an exchange at full production speed 10 to 20 meters of sliver are placed between the can. With this device, the cutting plane is also arranged transverse to the feed direction of the slubbing. One of the sheer blades is stationary and the sliver is passed through underneath The other shear blade is arranged in a pivotable manner with respect to the first sheer blade. The effects of the cutting step should be as disadvantageous as described above but most likely, the respective cutting step must be carried out with the sliver being stopped. This, however, reduces the economy of operation. Finally, it is known from DE-OS 17 60 857 to employ a cutting element in the form of a chisel-shaped cutting knife which is cutting transverse to the direction of the sliver. The cutting knife is linearly inserted into a stretched cutting channel by passing it through a sliver channel whereby the cutting channel is provided with upper and lower contact edges, in order to avoid offset during the cutting step. This cutting knife is inserted in a sudden manner due to a supported piston-cylinder control unit. The sliver is pulled via calender rolls. When the sliver is separated from the rolls a further transport is not ensured. A breakdown is the result.

It is therefore an object of the present invention to provide a can coiler with a sliver cutting device which does not have any negative effects on the transport of the sliver so that the quality of sliver is not negatively influenced and for which it is irrelevant whether the slubbing is a short fibered woven material of vegetable or animal origin or, in particular, whether it is made of endless respectively long filaments such as synthetic fibers.

SUMMARY OF THE INVENTION

According to the embodiments of the present invention a secure and fast cutting of the sliver is achieved. Negative effects such as the aforementioned jerking etc. do not occur. The sliver structure is not exposed to spontaneous loads. Therefore, the density of the sliver is not disadvantageously influenced. Rather, a quiet and uniform feed is ensured. Moreover, peak loads at the device are prevented. The device may therefore be of a compact design and may provide as well the possibility to cut at full operation speed. All these features can be provided by having a cutting element in the form of a cutting knife the support of which is such that, for the cutting step, the cutting blade is inserted into the circular path by generating a pulling cut, whereby the cutting knife, in the cutting position, extends to a radial line of the circular path whereby the radial line is essentially vertical to the cutting edge of the cutting knife. The cross section of the sliver thus does not contact the cutting edge at an obtuse angle, but due to cutting in a pulling manner, the cutting effect is distributed over the angle of rotation so that the cutting effect is only slowly increased. The sliver is guided onto a continuously rising cutting ramp. Furthermore, the sliver is rotated under the cutting effect due to the rotation of the can coiler turntable. The sliver is cut in a clean manner. It is furthermore suggested that the blade of the cutting knife is supported with one end at a vertical bolt and is thus pivotable at the machine frame. For moving the blade a drive device is provided. The respective pivotability of the blade favors the use of a very short actuation stroke by utilizing the lever effect. The blade can be inserted and retracted in a sudden manner. It is advantageous to provide the drive device in the form of a piston/cylinder unit the piston rod of which engages, spaced at a distance from the pivoting axis of the cutting knife, engages the cutting blade, whereby the cutting knife. In its cutting position, extends to a radial line of the circular path of the sliver, with the radial line being essentially vertical to the edge of the cutting knife. In order to reduce the time of the covering of the outlet channel, i.e., freeing the outlet channel after the cutting has taken place as soon as possible, the embodiment is characterized by having an acute angle between the edge and the head surface of the cutting knife which extends in the circumferential direction of the sliver path. The respective undercut may be chosen at such a great angle that, when cutting the last fibers, more than two thirds respectively almost the entire cross section of the outlet channel is already open. Furthermore, it is advantageous that the piston rod of the piston/cylinder unit is arranged approximately parallel to the radial line, i.e., that it extends essentially vertical to the edge of the cutting knife. This results in an optimized actuation direction with respect to the occurring forces. A further advantageous embodiment is provided with a limit switch that activates the piston/cylinder unit and which receives its impulse from a trip switch located at the turntable respectively turning ring. Furthermore, in this context, it is advantageous that the cutting device is activated depending on the activation of the limit switch and the position of a can for receiving the sliver. This will assure a fully automated operation with no low-quality products. An advantageous alternative solution of the cutting knife arrangement according to the present invention comprises a cutting knife in which the edge that provides the pulling cut is arranged on the outer side of the cutting knife that is spaced farther apart from the center of the circular path, whereby the tip of the cutting knife points against the direction of rotation. The sliver passes through an essentially hook-shaped cutting device. The sliver forcefully passes the edge. None of the fibers can reach an offset position. A further advantages of this version is that the cutting pressure is not applied against the pressure medium of the piston/cylinder unit, but is absorbed by the rigid end position abutments of the cylinder. A further advantage of this solution is also that the fiber and dust remains are removed from the groove via the inserted cutting knife. The cutting knife thus is working in a shovel like or plow-like manner and functions in a self-cleaning fashion whereby the removal of the aforementioned remains is additionally assisted by centrifugal forces. It is also advantageous that the cutting knife at its free end is pointed. Accordingly, there is no need for an especially deep transverse groove to be cut into the turntable. Under consideration of the space requirements for the pivoting action of the cutting knife, one specific embodiment has been proven to be advantageous whereby the angle of the pointed end of the cutting knife is 10° and the angle of the side of the cutting knife that is facing the center point of the circular path, in its cutting position, is 90° relative to the radial line.

BRIEF DESCRIPTION OF THE DRAWINGS

The present invention will now be described in detail in the following paragraphs with the aide of an embodiment represented in the drawings in which.

DESCRIPTION OF THE PREFERRED EMBODIMENTS

The can coiler 1 integrated in a linear changer has a turntable 2. The latter rotates in the direction of the arrow X.

Figure 8:
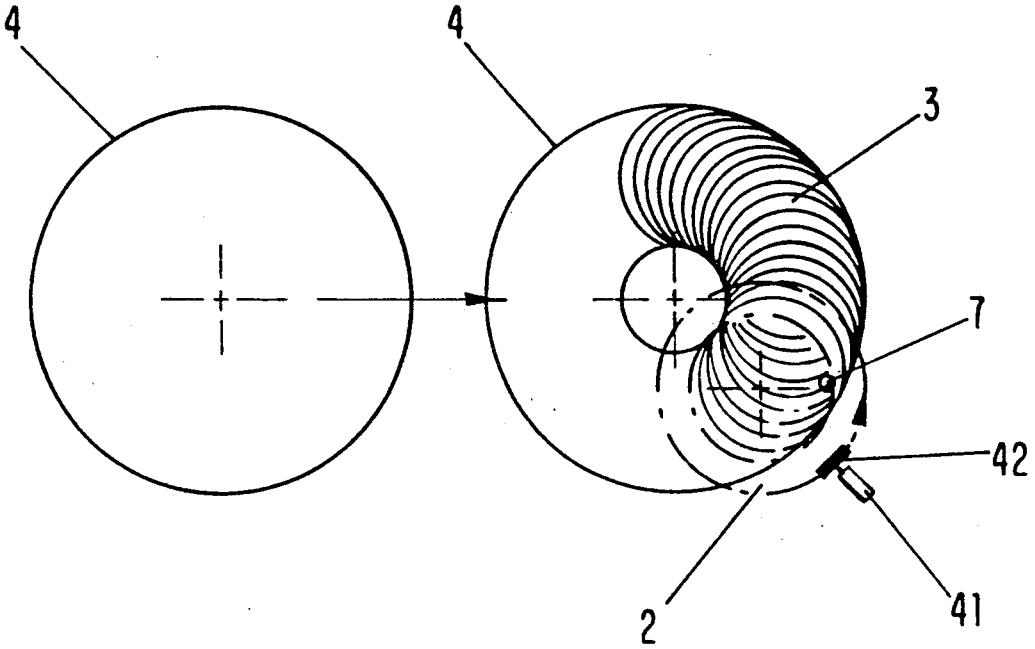
FIG. 8 is a schematic plan view of a linear changer.
Figure 9:
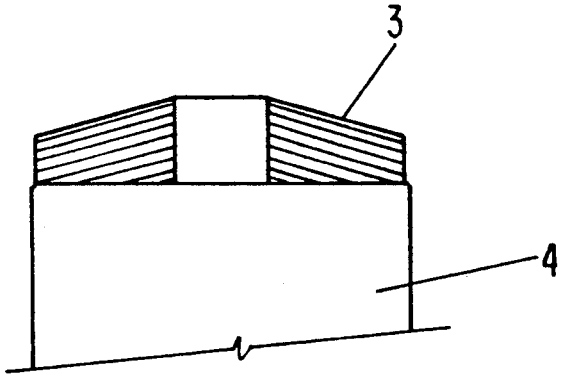
FIG. 9 shows the placing of the sliver in a cross sectional view and FIG. 10 is a view of a variant of the cutting knife showing the inserted position of the cutting knife represented in a dotted dashed line.

Via the turntable 2 a sliver 3 transported towards the can coiler 1 is deposited into the can 4. The latter stands on a rotary plate 5 at the bottom 6 of the can coiler 1 The deposition takes place in a circular and rising manner whereby due to the rotation of the turntable 2, having an opening 7 for the sliver 3 that is disposed in an eccentric manner at the turn-table 2 a coiled arrangement results, as shown in FIG. 8. The opening 7 is formed by a nozzle 8 that opens in an upward direction in a funnel-shaped manner. In a vertical downward direction an outlet channel 9 communicates with the nozzle 8 whereby the outlet channel 9 is partially formed by the material of the turntable 2 and partially formed by a tube 10 that is arranged above.

The end section of the nozzle 8 which points in a downward direction extends deep down into the wedge between two calender rolls 11. The calender rolls 11 which are supported at the pot-shape turntable 2 pull the sliver 3 in a downward direction and push it through the smooth outlet channel 9 onto the bottom side of the can coiler head.

The upper end of the tube 10 is shaped correspondingly to the cylindrical calender roll contour.

The drive of the calender rolls 11 results from the rotation movement of the turntable 2. This drive is realized in the form of a belt drive. The components of the belt drive are arranged, as are the calender rolls, in the pot-shaped space of the turntable 2 which is provided at its upper end with a lid 12.

Figure 7:
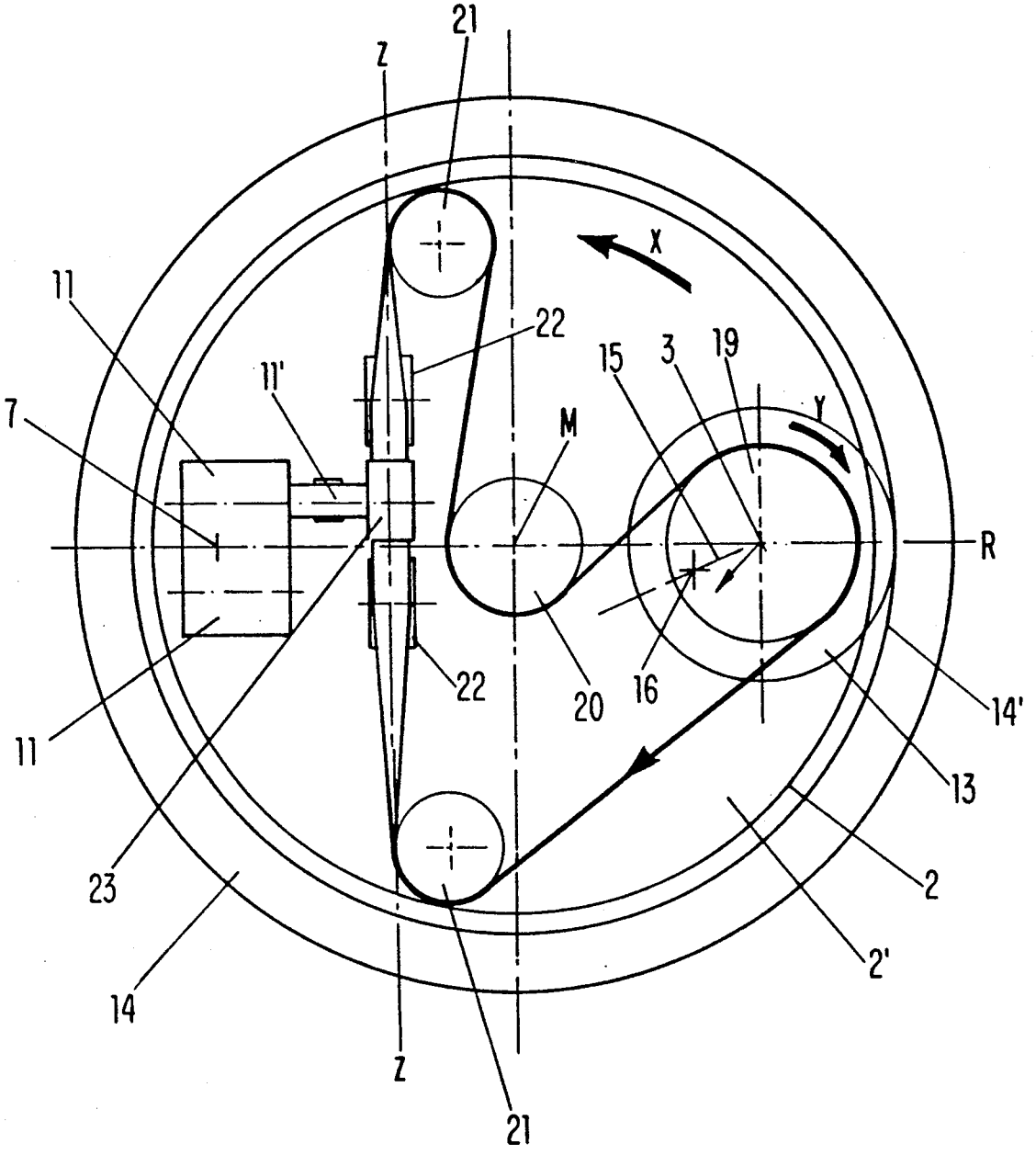
FIG. 7 is a plan view of the turntable of the can coiler showing the drive of the calender rolls.

The rotational movement is transformed via a friction wheel 13. The friction wheel 13 rolls on an inner annular surface 14' of a stationary annular body 14 that is arranged at the can coiler head. The friction wheel 13 is loaded by the belt tension in the direction of contact. The friction wheel 13 is located on a guide 15. The guide 15 is pivotable about an axis 16. The axis 16 extends from the bottom 2' of the pot-shaped turn table 2. The side wall of the pot is designated by the reference numeral 2''. The pivoting axle which carries the friction wheel 13 is designated by the reference numeral 17. The pivoting axle 17 extends in an upward direction in order to attach thereto a belt pulley 19 that transmits the rotational movement of the friction wheels 13 to the drive belt 18. In addition to the belt pulley 19 the belt drive encompasses a total of six further guide pulleys. One of the guide pulleys (designated by reference numeral 20) is located at the center point M of the turntable 2. Two further ones, as the belt pulley 19, are arranged at the circumference of the turntable 2 and are designated by reference numeral 21. The three remaining belt pulleys 22, 22 and 23 are arranged along the connecting line Z—Z which corresponds to the shortest connection of the two belt pulleys 21 that are arranged on the calender roll side of the apparatus, whereby the belt pulleys 22, 22 and 23 are arranged on axes parallel to the turntable plane such that two belt pulleys 22, 22 are disposed on either side of the belt pulley 24 that is arranged on the calender roll axis 11'. Thereby a V-shaped folding of the belt section resulting in an optimum slip-free guidance of the belt 18 is achieved. The respective 90° twisting of the belt is well represented in FIGS. 2 and 7.

The lower portion of the can coiler head is embodied as a centrally supported disc 25. The disc 25 is freely rotatable and coincides with the bearing axis of the central belt pulley 20 and may have a flat, slightly dome-shaped bottom.

The outer annular surface 14" that is opposite the inner annular surface 14' of the annular body 14 receives a wire coil bearing 26 via which the turntable 2 is supported by a bearing ring 27 at the can stock head.

Figure 2:
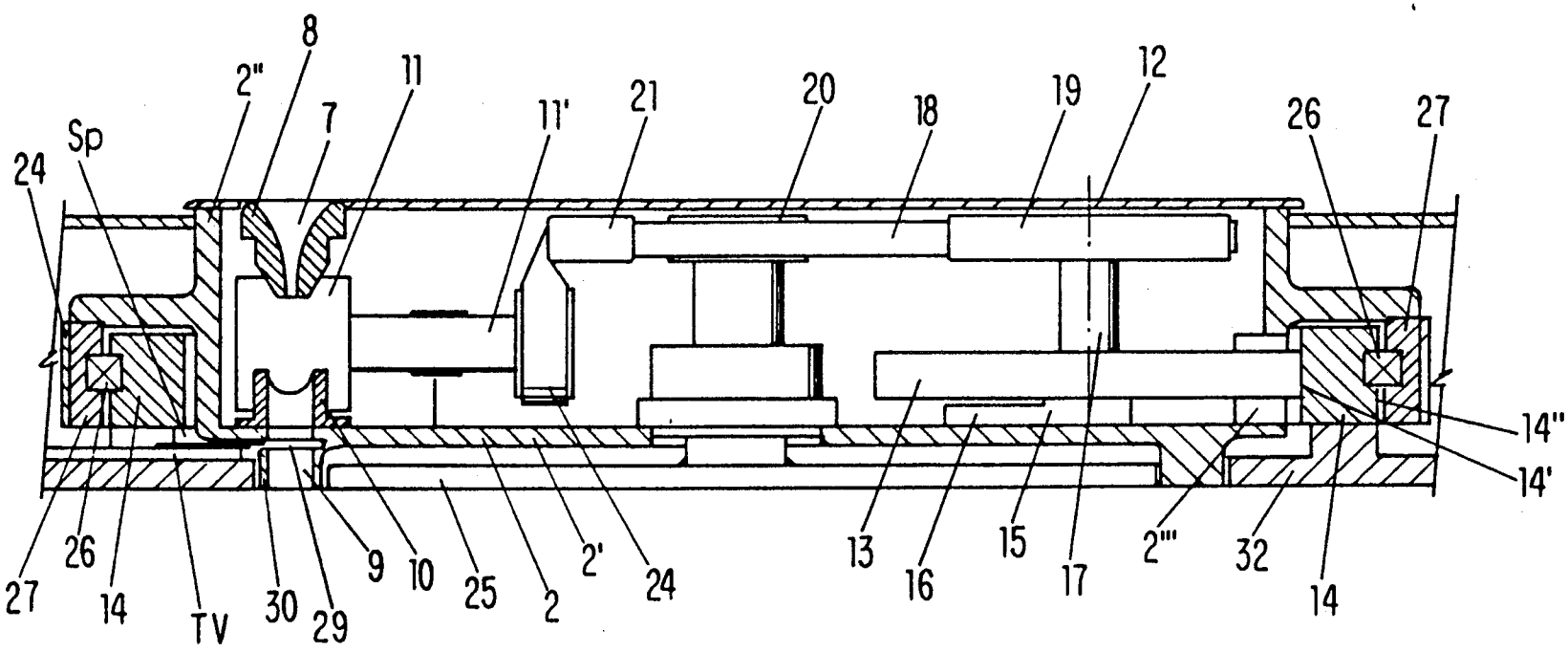
FIG. 2 is a vertical cross section of the can coiler representing the inventive sliver cutting device with a retracted cutting knife.

As can be seen in FIG. 2, the friction wheel 13 penetrates a window 2''' in the mantle wall of the pot-shaped turntable 2.

In order to interrupt the sliver 3 for the can exchange, a cutting device TV is provided in the area of the can coiler head at the can coiler 1. The cutting device is provided with a cutting knife 28. The support of the cutting knife 28 is embodied such that the cutting edge 28', for the cutting step, is introduced into the circular path U of the outlet channel 9 in a direction transverse to the longitudinal extension of the sliver 3, thus reaching a cutting position. In order to reach this cross sectional area the turntable 2, at the lower side of its bottom 2', is provided with a horizontally extending transverse groove 29. The transverse groove 29 is continuously rolled and is located at a thicker portion 30 of the bottom 2', protruding in a downward direction and shaped like an annular flange. The thicker portion 30 corresponds approximately to the thickness of the turntable bottom 21 at its inner side. The thicker portion 30 also serves to partially the vertically extending cylindrical outlet channel 9.

It can be taken from the drawings that the sliver cutting device TV is arranged lateral to the periphery of the turntable 2 having the outlet channel 9.

The blade of the cutting knife 28 is pivotable at one end about a vertical bolt 31. The bolt 31 is in the form of a stay bolt which extends from the machine frame, in this case from the pressure plate 32 of the can coiler head.

The cutting knife 28 is moved back and forth with the aid of an electrically or electronically controlled drive device 33 from its resting position into the cutting active position. For this purpose a drive device is provided which is realized as a pneumatic piston/cylinder unit. The piston rod 34 engages, spaced at a distance from the pivoting axis (vertical bolt 31) of the cutting knife 28, in a joint-like manner. The engagement is achieved in an indirect manner due to the interposition of an angular actuating member 35 which is formed from sheet material. The longer leg slides on the upper side of the pressure plate 32 and extends into the relatively small slot area Sp between a rim section of the bottom 2' of the turntable 2 and the somewhat elevated annular body 14. The shorter vertical leg of the actuating member 35 represents the attachment for the free end of the piston rod 34. The piston rod 34 is provided with an outer thread 36. Two nuts 37 permit a fine adjustment of the actuating member 35 for the exact positioning of the cutting knife 28.

The joint bolt between the actuating member 35 and the cutting knife 28 is designated by the reference numeral 38 and is positioned approximately at half the length of the blade whereby it is positioned slightly backwards relative to the back of the blade. In a stationary piston/cylinder unit, a slotted hole embodiment in this area would provide the necessary compensation for the required movement; it is however sufficient, that the cylinder 39 of the drive device 33 is supported in a pivotable manner about a vertical axis. This alternative, however, is not represented. It is preferred to employ the first mentioned coordination providing a respective stationary position of the cylinder 39 on a vertical support 40 that is connected to the pressure plate 32.

Figure 6:
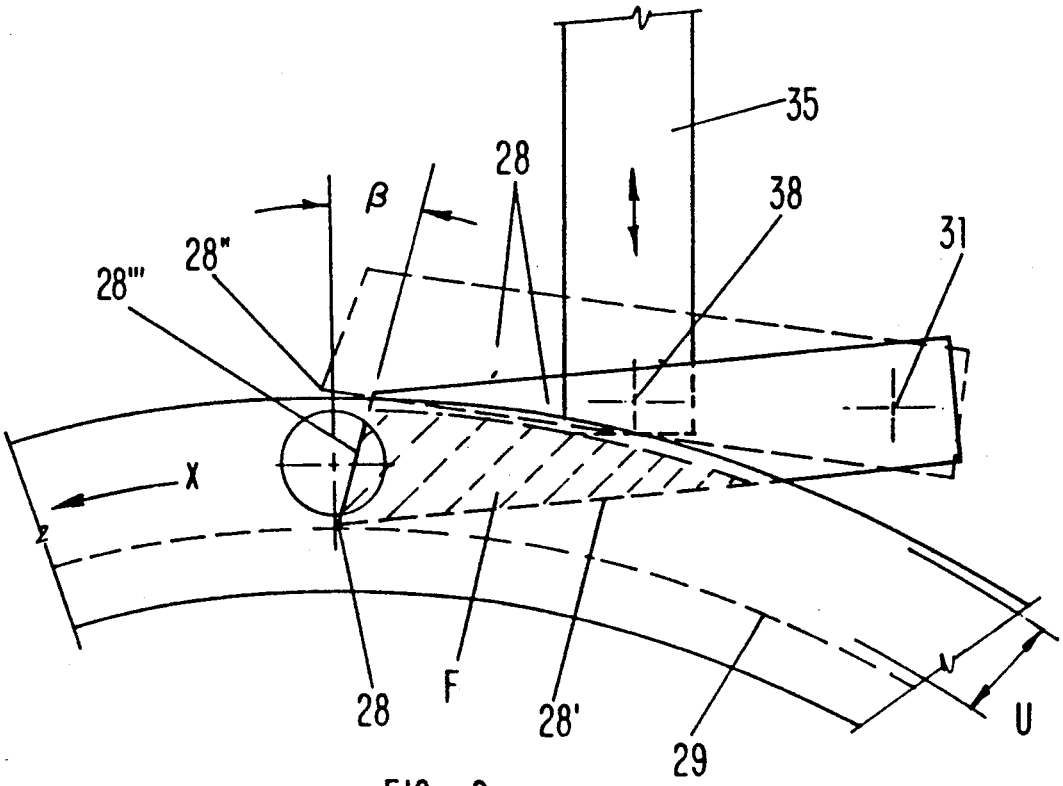
FIG. 6 shows the same representation during the cutting step but showing the cover that is marked in a cross hatched manner during the cutting step.

Considering the secant-like position of the cutting knife 28 in its cutting position, moved toward and essentially tangent to the circular path, an essentially vertical alignment of the blade 28' with respect to an imaginary radial line of the turntable 2 results, whereby the radial line R intersects the cutting knife end 28". In the shown embodiment the respective angle $\alpha$ between the radial line R and the edge 28' is 95°. In the disengaged position the respective angle is approximately 82°. The head surface 28''' of the cutting knife 28, is slanted in a direction opposite to the circumferential direction X. The respective acute angle $\beta$, with respect to the radial line R as a basis, is approximately 15°. Due to this slanted portion the area F of coverage in the cutting step is shortened. The area F of coverage in FIG. 6 is represented in a crosshatched manner. The outer border of the area F of coverage is determined by the circular borders of the circular path U on the one side and the inner border of the area F of coverage is limited by the edge 28'.

The piston rod 34 extends essentially parallel to the radial line R.

Figure 5:
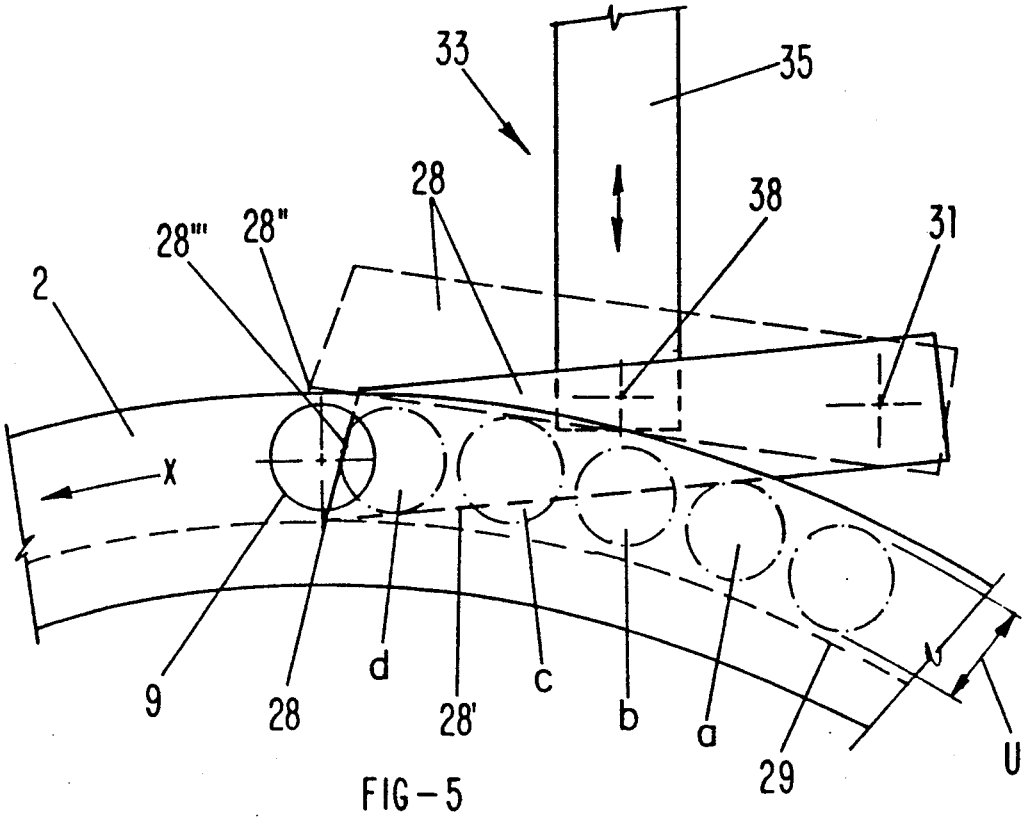
FIG. 5 is a representation according to FIG. 4 enhancing a movement study of circular path of the outlet channel with the cutting knife being in a cutting position.

The immersion of the sliver cross section (defined by the circular cross section of the outlet channel 9) into the cutting zone of the cutting knife 28 is clearly shown in FIG. 5. The movement study represented therein shows the first point of contact of the knife at position a. The direction of transportation is essentially at an acute angle. The cross section of the sliver passes over the edge 28' which is facing in the center of the circular path U and is, after passing a distance of about one and a half times the dimension of the outlet channel cross section, semi-compressed and partially cut (position b). After a further travel in the direction of the arrow X for about the same amount, the cross section of the sliver is out almost entirely (position c). Only in the following, very short phase a complete coverage of the outlet channel cross section occurs. Subsequent to this position d the outlet channel cross section is freed. The sections that are respectively covered by the blade are provided with a transport free section in the positions a to c, in which the partial cross section of the sliver 3 is further transported by the calendar rolls 11. The structure is also determined by the sliver 3 being rotated relative to the edge 28'. This rotation and the extreme acute transport of the sliver cross section to the edge 28' results in an optimum cutting process.

Figure 3:
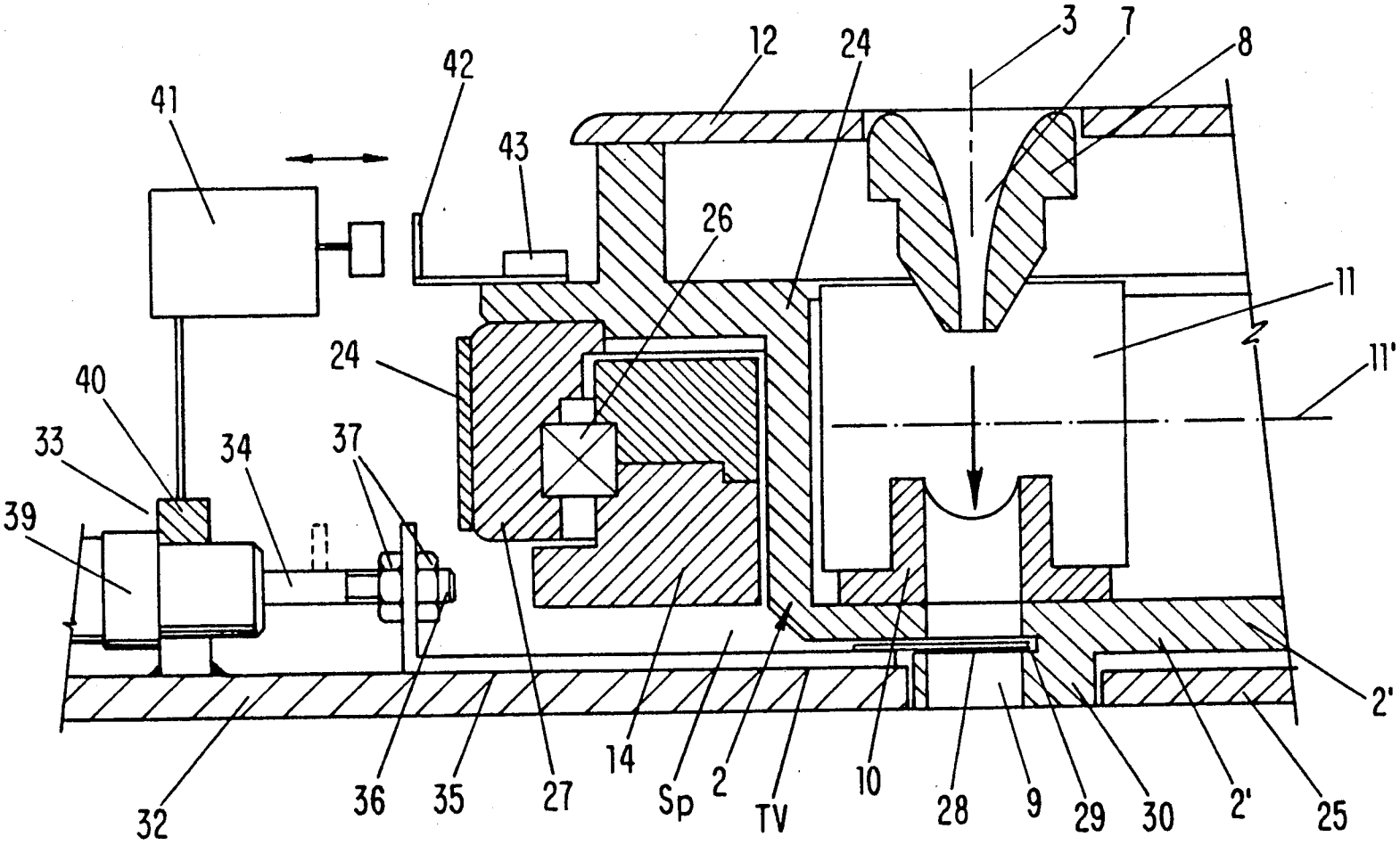
FIG. 3 shows an enlarged view of the sliver cutting device with a cutting device in its cutting position.
Figure 4:
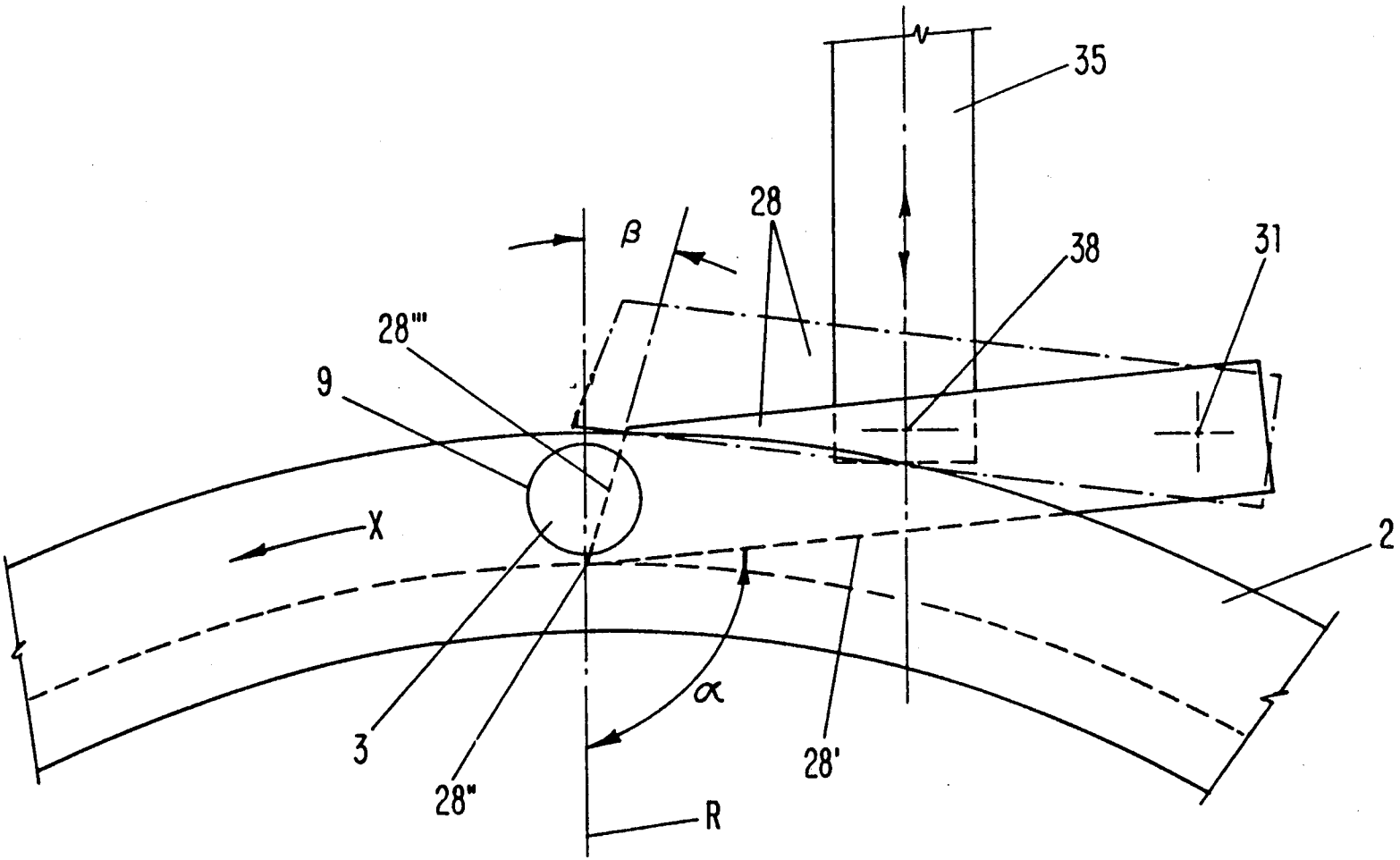
FIG. 4 is a schematic plan view of FIG. 3.

The exact timing of the insertion of the cutting knife 28 is realized in a motion-dependent control respectively tripping, especially via a limit switch 41 activating a piston/cylinder unit (compare FIG. 3). The limit switch 41 receives its impulse from a trip switch 42 that is arranged at the turntable. This trip switch 42 and/or the limit switch 41 may be exactly positioned. The trip switch 42 is provided with a radial slotted hole, which is penetrated by the shaft of a holding screw 43. This sliver cutting device TV is actuated depending upon the activation of the limit switch 41 and the position of the can 4, which is monitored by a respective switch or sensor, for receiving the sliver 3. (This will be explained in detail in the following paragraphs). The control of the cutting process thus is achieved in an electric manner. It may also be computer-controlled.

In the following, the activation of the sliver cutting device TV under consideration of the position of the opening 7 and the position of the can 4 will be explained, whereby the position of the filled can 4 or the position of a can 4 to be filled in the following cycle will be the basis.

Figure 1:
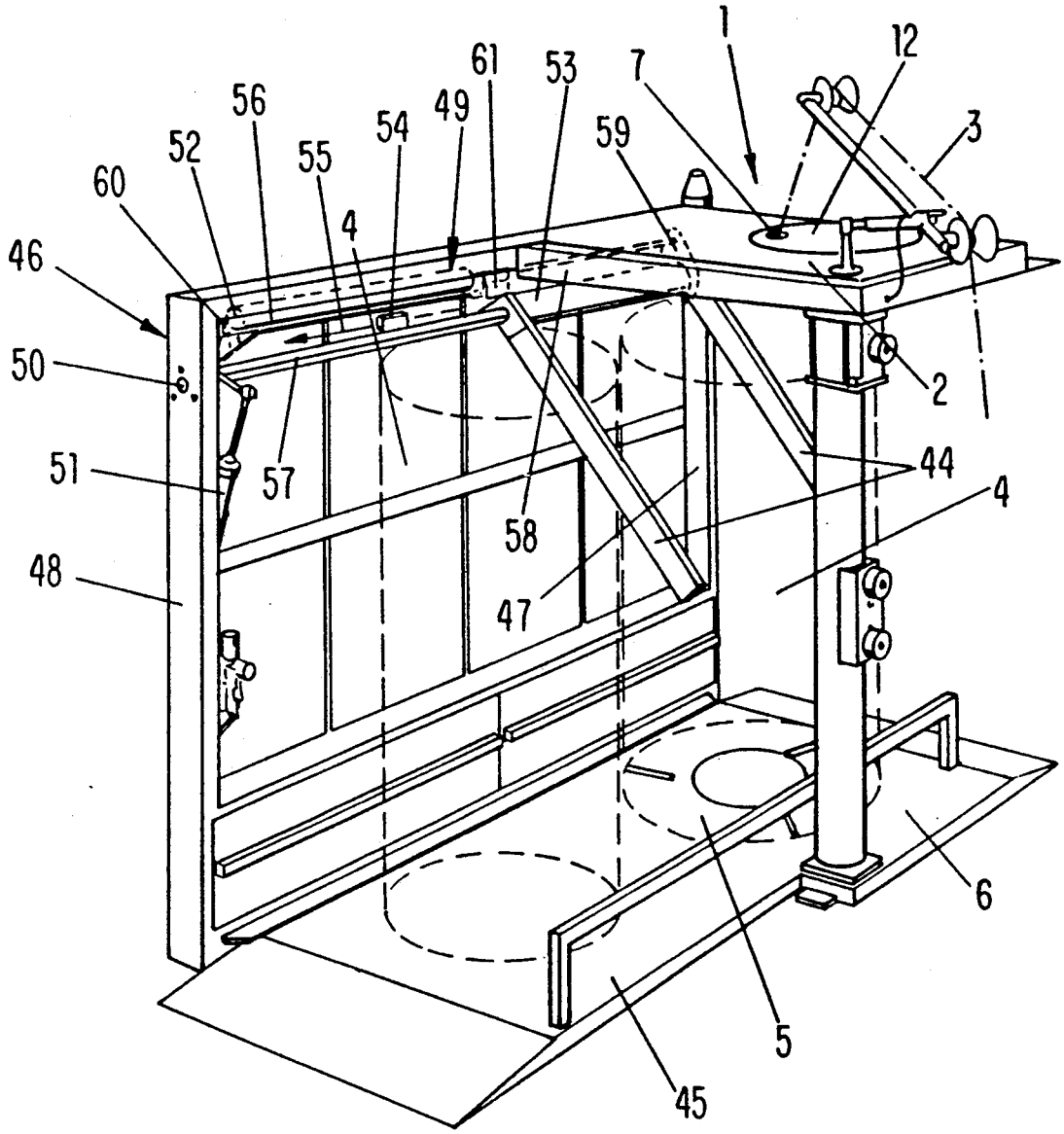
FIG. 1 shows a can coiler of the present invention in the form of a linear changer in a perspective representation.

The can exchange is achieved via the device represented in detail in FIG. 1, having a path 45 for the cans 4 which are represented by a dash-dotted line, and border on one side a console 46. Between the faces 47 and 48 of the console 46 a can moving unit 49 is disposed. The can moving unit 49 is provided with a piston/cylinder arrangement 56, a polygon profile 57, a carrier 53 which is slidable in a longitudinal direction on the polygon profile 57 but is non-rotatable, as well as arms 44 that are attached to the carrier 53. The piston rod 58 of the piston/cylinder unit 56 engages with its free end a latch 59 of the can moving unit 49. While the piston rod 58 is non-rotatably connected to the latch 59, the ledge 59 is supported rotatably but non-slidably at the carrier 53. The faces 47 and 48 are provided with respective bearings 50 which support the polygon profile 57. Via a further piston/cylinder unit 51 the polygon profile 57 is pivotable via a pivoting lever 52 so that the arms 44 attached to the carrier 53 may be moved from a downwardly pointing vertical position into a lifting position (according to FIG. 1) and vice versa. The arms 44 are spaced at a distance from one another which corresponds approximately to the outer diameter of a can 4.

In the horizontal moving path of the carrier 32, an electric switch 54 is arranged which is only schematically represented manner. Also, the two end sections of the cylinders of the piston/cylinder unit 56 are provided with a respective end switch 60 respectively 61 which are also only schematically represented. The switches 54, 60 and 61 are triggered corresponding to the movement end position of the carrier 53 and may be actuated mechanically or by approaching (preferably Reed contacts are employed which are actuated by magnetic pistons of the piston/cylinder unit 56). The switch 54 is slidably supported in the direction of the double pointed arrows 55 and can be fixed in a desired position. Thereby the response with respect to the position of the can sliding unit 49 can be adjusted. The end switch 60 and 61 have the task to monitor the horizontal sliding path of the can moving unit 49. The end positions correspond to the receiving position of a new, not yet filled can 4, respectively the displacement position corresponding to the rotary disc 5.

The device works as follows: The piston/cylinder unit 56 and 51 are supposedly in a position represented in FIG. 1 whereby the can 4 on the rotary disc 5 is to be filled with sliver. During this filling process the piston/cylinder unit 51 is controlled such that the polygon profile 57 is rotated about the bearing 50 so that the arms 44 are moved into their vertically downwardly directed position. Subsequently, triggered by a control unit which is not represented in the drawing, the carrier 53 is moved into the direction of the face 48 until a position which corresponds to the waiting empty can 4 is reached. This movement is realized via a piston/cylinder unit 56 whereby the transmission of forces is achieved via the piston rod 58 and the latch 59. Then the arms 44 are adjusted into their lifting position via the piston/cylinder unit 51 so that they receive between them the empty can 4. When it is determined by suitable means (for example, by counting the can revolutions) that the can 4 which is undergoing the filling step is approaching its filled state the control unit initiates a movement of the piston of the piston/cylinder unit 56 in the direction of the face 47 so that the piston rod 58 and the latch 59 transport the carrier 53, and thus via the arms 44, the can 4 to be filled, whereby the filled can 4 is moved to the right hand side away from the device (FIG. 1). The horizontal movement of the arms 44 is carried out to a point where the new can 4 reaches its position on the rotary disc 5. During this movement the switch 54 is actuated which achieves a kind of "focusing". This means, that, at the moment when the limit switch 41, due to the approach of the switch 42, is activated and, at the same time, the focusing via the switch 54 is achieved, the drive device 33 receives a triggering impulse. Now the cutting knife 24 is moved into a cutting position. The retraction of the knife is actuated depending on the rotating speed of the opening 7, i.e., as previously explained, in an interval relative to the insertion of the knife which is smaller or at most equal to the rotation time of the opening 7.

It is clear from the previous explanations that the exact time of the sliver cutting can be adjusted via the positioning of the switch 54 along the double pointed arrows 55. The position of the switch 54 determines the positions of the can 4 that is filled or is to be filled at the time of the cutting process.

It is thus possible to perform a cut at a moment when the can 4 which has been filled has already left the rotary disc 5. The result is that the end of the sliver 3 extends passed the filled can. At the same time, this cutting moment results in the insertion of the beginning of the further fed sliver into the new can 4 to be filled, so that the sliver does not protrude from the can. If the moment of the cutting step is chosen to be at an earlier time when the filled can has not yet completely left the rotary disc 5, a constellation results in which the end of the sliver of the can to be filled as well as the end of the sliver of the can to be filled will protrude past the rim of the can. A further advancement of the cutting moment relative to the position of the cans can be realized such that the end of the sliver of the filled can will come to rest on the sliver support thereby not protruding from the can, while the formed sliver beginning will extend past the rim of the can 4 to be filled. Corresponding to the desired requirements the length of the protruding sliver ends respectively the position of the sliver ends or beginnings relative to the respective may be adjusted.

It is especially advantageous that due to the inventive cutting of the sliver the revolving speed of the opening 7 during the cutting step respectively during the can exchange must not be reduced. This results in an expedient operation. Furthermore, the constant revolving speed of the opening 7 (and therewith the constant delivery speed of the sliver 3) ensures that no production or quality loss will occur.

A further advantage is that the cutting knife 28 is provided in an exchangeable manner so that when a blade becomes dull respectively when a blade breaks, quick relief may be provided.

The present invention is not restricted to the linear exchanger for cans 4 as represented in FIG. 1 but may, for example, also be used with so-called revolving exchangers. In such revolving exchangers, the cans 4 are not linearly guided but are guided on a circular path.

Figure 10:
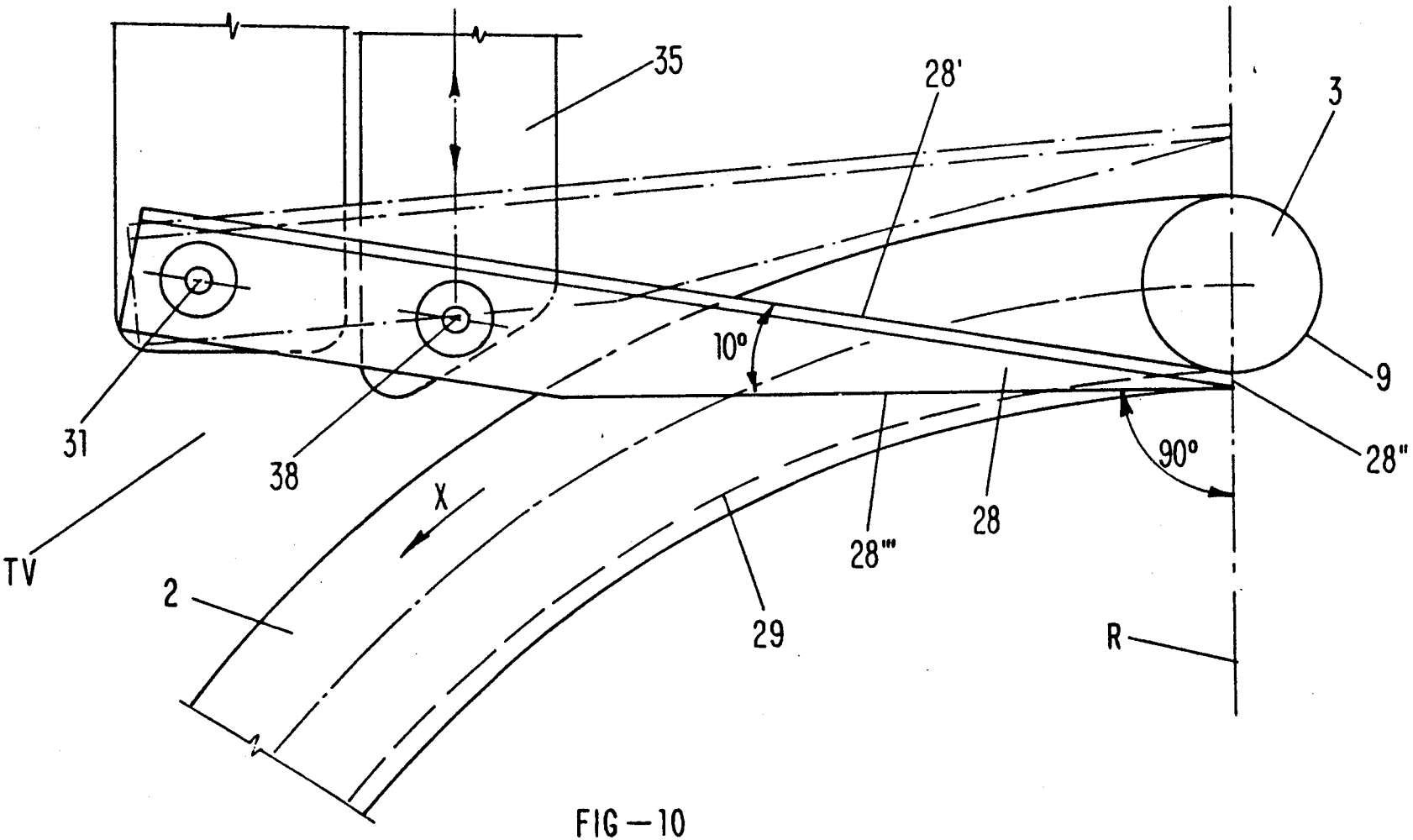

The variant of the inventive cutting knife 28 as represented in FIG. 10 realizes the same advantageous principal with respect to the pulling cut as explained for FIGS. 1 to 9. The reference numerals, when structural and functional identity is provided, are used for the same parts whereby respective identical portions of the text are not repeated. In contrast to the aforementioned embodiment, the edge 28' of the cutting knife 28 is arranged on the outer side of the circular path U, i.e., is pointing away from the aforementioned center.

Also, with respect to the support and the control of the cutting knife, a reverse order is provided whereby the tip of the cutting knife 28'', i.e., the free end of the cutting knife 28, is directed counter to the transport direction X. This results in the consequence that the sliver 3, when the cutting knife 28 is introduced into the circular path U, is forced over the blade 28'. The cutting knife 28 thus engages in a hook-like manner the transverse groove. All of the fibers are cut and none of the fiber sections can reach an offset position.

The cutting knife 28 which is also pivotable about a stationary pivoting point 31 is finely adjustable via a respective adjustable carrier of a vertical bolt 31 that is forming the pivoting axis. Directly adjacent an actuating member 35 extends essentially parallel, which has been described in detail in the paragraphs set forth above and is moved via said piston/cylinder unit. It is thereby of interest that the cutting pressure acting on the edge 28' of the cutting knife 28 is no longer acting on the medium which is loading the piston of the piston/cylinder unit. The cutting pressure is merely absorbed by the rigid end abutment of said cylinder. In order to achieve a relatively small pivoting stroke the free end of the cutting knife 28 is tapered off at an acute angle. The respective acute angle is approximately 10° whereby the side of the cutting knife facing the center point of the circular path U in its cutting position together with the radial line (FIG. 10) encloses an angle of approximately 90°. Thus, a relatively short working stroke of the piston/cylinder unit is sufficient. The pointed end of the knife is tapered in a continuous manner and the tapering begins already at the area of the joint bolt 38. The tapering also provides an extreme head surface undercut 28''' which frees almost completely the cross section of the sliver in the freed direction (direction of transport) of the sliver right from the beginning.

Due to the hook-like respectively shovel-like or plow-like position of the cutting knife 28, the advantage results that due to means already present, a removal device for fiber and dust particles collecting in the transverse groove 29 is provided. The fiber and dust particles are spontaneously removed. It is also possible to provide in this area a vacuuming device for the removal of the particles which is not represented in the drawings.

The non-cutting position of the cutting knife 28, i.e., the retracted position, is represented in FIG. 10 in a dash-dotted line.

The features of the invention as disclosed in the above description, the drawings and the claims may be taken individually or in any desired combination for the realization of the present invention.

The present invention is, of course, in no way restricted to the specific disclosure of the specification and drawings, but also encompasses any modifications within the scope of the appended claims.

What I claim is:

1. In a can coiler with an outlet channel for delivering a sliver to a can, said outlet channel being fastened to a rotating turn table and following a circular path, and with calender rolls, for transporting said sliver, being rotatably fastened to said turntable upstream said outlet channel, and having a sliver cutting device with a cutting element that is movable, transverse to a longitudinal direction of said sliver, into and away from said circular path of said outlet channel and into and out of a peripheral groove comprised by said turn table, the improvement wherein:

said cutting element consisting of a cutting knife with a blade and a cutting edge for a cutting process, said process consisting of a pulling cutting action, said knife being moved into said circular path into a cutting position so as to cut the sliver, with said cutting edge in said cutting position extending to a radial line of said circular path, said radial line being essentially perpendicular to said cutting edge.

2. The can coiler according to claim 1, wherein said blade of said cutting knife has a portion pivotably supported by a vertical bolt and has another portion connected to a drive means for displacing said blade, wherein said drive means comprises a piston/cylinder unit with a piston rod, said piston rod being spaced from said bolt and connected to an actuating member for actuating said cutting knife.

3. The can coiler according to claim 2, wherein said piston rod extends approximately parallel to said radial line and essentially perpendicular to said cutting edge.

4. The can coiler according to claim 2, further comprising a limit switch for actuating said piston/cylinder unit and a trip switch fastened to said can coiler, said limit switch receiving an impulse from said trip switch, with said sliver cutting device being activated in response to an actuation of said limit switch and a rotational position of the can for receiving said sliver.

5. The can coiler, according to claim 1, wherein an acute angle is formed between said cutting edge and a head portion of said cutting knife, with said head portion positioned in a direction of rotation of said turn table.

6. The can coiler according to claim 1, wherein said cutting edge providing said pulling cutting action is located on a side of said cutting knife facing outward and away from a center of said circular path and a free end of said cutting knife is positioned against a direction of rotation of said turn table.

7. The can coiler according to claim 6, wherein said free end of said cutting knife is tapered.

8. The can coiler according to claim 7, wherein an angle of tapering is approximately 10° and a side of said cutting knife that is facing said center of said circular path, in a cutting position thereof, encloses an angle of approximately 90° with a radial line of said circular path.

* * * * *